US011614694B2

(12) United States Patent
Kakehi et al.

(10) Patent No.: US 11,614,694 B2
(45) Date of Patent: Mar. 28, 2023

(54) ELECTROSTATIC IMAGE DEVELOPER, PROCESS CARTRIDGE, IMAGE FORMING APPARATUS, AND IMAGE FORMING METHOD

(71) Applicant: FUJIFILM Business Innovation Corp., Tokyo (JP)

(72) Inventors: Soutaro Kakehi, Kanagawa (JP); Sakon Takahashi, Kanagawa (JP); Yutaka Saito, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 141 days.

(21) Appl. No.: 16/926,819

(22) Filed: Jul. 13, 2020

(65) Prior Publication Data

US 2021/0240096 A1 Aug. 5, 2021

(30) Foreign Application Priority Data

Jan. 31, 2020 (JP) ..... JP2020-015622

(51) Int. Cl.

| | |
|---|---|
| ***G03G 9/09*** | (2006.01) |
| ***G03G 9/08*** | (2006.01) |
| ***G03G 15/08*** | (2006.01) |
| ***G03G 9/107*** | (2006.01) |

(52) U.S. Cl.

CPC ..... *G03G 9/0825* (2013.01); *G03G 9/0819* (2013.01); *G03G 9/0902* (2013.01); *G03G 9/1088* (2020.08); *G03G 15/08* (2013.01)

(58) Field of Classification Search

CPC ..... G03G 9/09708; G03G 9/09783; G03G 9/09791; G03G 9/1139

See application file for complete search history.

(56) References Cited

U.S. PATENT DOCUMENTS

| | | | | |
|---|---|---|---|---|
| 9,740,120 | B1 | 8/2017 | Saito et al. | |
| 2006/0222988 | A1* | 10/2006 | Tanida | G03G 9/09708 430/108.6 |
| 2007/0048652 | A1* | 3/2007 | Imahashi | G03G 9/1136 430/111.33 |
| 2018/0088481 | A1* | 3/2018 | Kayamori | G03G 9/0902 |

FOREIGN PATENT DOCUMENTS

| | | | | |
|---|---|---|---|---|
| JP | 2005-266560 A | | 9/2005 | |
| JP | 2010-044113 | * | 2/2010 | G03G 9/08 |
| JP | 2014-149503 A | | 8/2014 | |
| JP | 2017-146538 A | | 8/2017 | |

OTHER PUBLICATIONS

Translation of JP 2010-044113.*

* cited by examiner

*Primary Examiner* — Peter L Vajda
(74) *Attorney, Agent, or Firm* — Sughrue Mion, PLLC

(57) ABSTRACT

An electrostatic image developer includes a toner containing toner particles, a carrier, and an external additive containing titanium dioxide particles of two types having different refractive indexes, fatty acid metal salt particles, and an abrasive.

13 Claims, 2 Drawing Sheets

ELECTROSTATIC IMAGE DEVELOPER, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2020-015622 filed Jan. 31, 2020.

BACKGROUND

(i) Technical Field

The present disclosure relates to an electrostatic image developer, a process cartridge, an image forming apparatus, and an image forming method.

(ii) Related Art

Japanese Unexamined Patent Application Publication No. 2005-266560 discloses a toner for electrostatic latent image development, containing at least toner particles and an external additive. The external additive contains two types of additives containing titanium compound A and titanium compound B, and the toner particles have a volume-average particle diameter of 4 μm to 8 μm, a GSD of 1.23 or less, which indicates a volume particle size distribution, and a shape factor SF1 of 110 to 14. The powder resistivity and volume-average particle diameter of each of the titanium compound A and the titanium compound B satisfy predetermined conditions.

Japanese Unexamined Patent Application Publication No. 2017-146538 discloses a toner for electrostatic image development, containing toner particles, abrasive particles having two peaks in a number particle size distribution, and fatty acid metal salt particles having one peak in a number particle size distribution. When among the two peaks in the number particle size distribution of the abrasive particles, the particle diameter at the smaller diameter-side peak is Da, and the particle diameter at the larger diameter-side peak is db, and when the particle diameter at the one peak in the number particle size distribution of the fatty acid metal salt particles is Dc, and the volume-average particle diameter of the toner particles is Dt, relationships represented by formula (1) to formula (3) below are satisfied.

$$Da \leq 0.5 \times Dt \quad \text{Formula (1):}$$

$$Dc \leq 0.5 \times Dt \quad \text{Formula (2):}$$

$$Dt \leq db \quad \text{Formula (3):}$$

Also, Japanese Unexamined Patent Application Publication No. 2014-149503 discloses an image forming apparatus including an image holding member on which a latent image is formed, a developing unit which is disposed in a non-contact state with the surface of the image holding member so as to face it and which develops the latent image by supplying a nonmagnetic one-component developer containing a crystalline polyester to the image holding member, and a cleaning blade which is disposed in contact with the surface of the image holding member and cleans the transfer residual developer on the surface of the image holding member. The cleaning blade is disposed at a position where gravity acts in a direction in which the transfer residual developer reaching the cleaning blade by rotation of the image holding member is inhibited from entering the contact part between the cleaning blade and the surface of the image holding member.

SUMMARY

Aspects of non-limiting embodiments of the present disclosure relate to an electrostatic image developer which contains a toner containing toner particles, a carrier, and an external additive and which can suppress the occurrence of image density unevenness when a high-density image is repeatedly formed, as compared with an electrostatic image developer containing the external additive including only titanium dioxide particles of two types having different refractive indexes or crystallite diameters.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an electrostatic image developer including a toner containing toner particles, a carrier, and an external additive containing titanium dioxide particles of two types having different refractive indexes, fatty acid metal salt particles, and an abrasive.

BRIEF DESCRIPTION OF THE DRAWINGS

Exemplary embodiments of the present disclosure will be described in detail based on the following figures, wherein.

DETAILED DESCRIPTION

Figure 1:
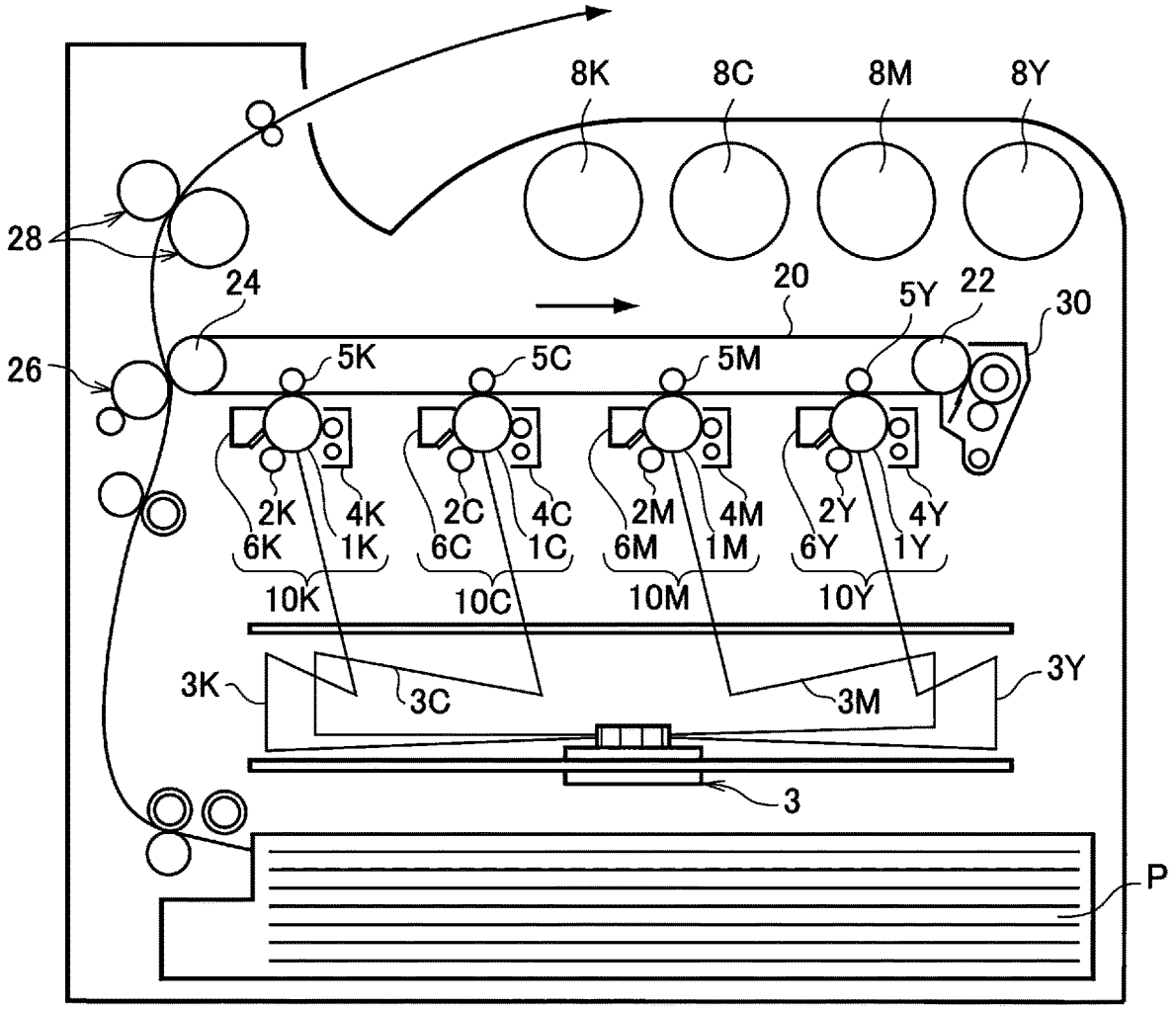
FIG. 1 a schematic configuration diagram showing an image forming apparatus according to an exemplary embodiment of the present disclosure.

The present disclosure is described in detail below by showing an exemplary embodiment. The description and examples exemplify the embodiment and do not limit the scope of the embodiment.

In the numerical ranges described stepwisely in the present specification, the upper limit value or lower limit value described in a numeral range may be replaced by the upper limit value or lower limit value in another numerical range described stepwisely. In addition, in a numerical range described in the present specification, the upper limit value or lower limit value in the numeral range may be replaced by the value described in an example.

In the present specification, the term "process" includes not only an independent process but also a process which achieves a desired purpose even when it cannot be clearly discriminated from another process.

Each of the components may contain plural corresponding substances.

In the description of the amount of each of the components in a composition, when plural substances corresponding to each of the components are present in a composition, the amount represents the total amount of the plural substances present unless otherwise specified.

<Electrostatic Mage Developer>

An electrostatic image developer according to an exemplary embodiment of the present disclosure contains a toner containing toner particles, a carrier, and an external additive.

The external additive contains titanium dioxide of two types having different refractive indexes or crystalline diameters, fatty acid metal salt particles, and an abrasive.

The electrostatic image developer according to the exemplary embodiment of the present disclosure has the configuration described above and thus suppresses the image density unevenness caused when a high-density image is repeatedly formed. The reason for this is supposed as follows.

There is known a technique for improving charge retention properties and improving transfer properties by externally adding, to a toner, titanium dioxide particles of two types having different characteristics.

However, printing with a high image density is continued, the two types of titanium dioxide particles may be transferred to the surface of the carrier, and thus a difference in negative polarity may occur between the two types of titanium dioxide, thereby causing nonuniformity in a portion of a conductive path. Therefore, the charge exchangeability between the toner and the carrier may be partially decreased, and image density unevenness consequently may occur with widening of a charge distribution.

The electrostatic image developer according to the exemplary embodiment contains, as the external additive, the titanium dioxide particles of two types having different refractive indexes or crystalline diameters, the fatty acid metal salt particles, and the abrasive.

The charge retention properties are improved by containing the titanium dioxide particles of two types having different refractive indexes or crystalline diameters as the external additive.

Also, by containing the fatty acid metal salt particles as the external additive, the titanium dioxide particles of one of the two types of the titanium dioxide particles are preferentially adhered to the fatty acid metal salt particles. Thus, among the two types of titanium dioxide particles, the ratio of the titanium dioxide particles of the one type present on the surface of the carrier is increased. That is, it is possible to suppress a partial decrease in charge exchangeability due to the nonuniform resistance of the carrier surface, which is caused by a mixture of the two types of titanium dioxide particles on the surface of the carrier. In this case, the preferential adhesion of the titanium dioxide particles of the one type to the fatty acid metal salt particles is supposed to be due to the electrostatic interaction between the fatty acid metal salt particles and the titanium dioxide particles.

Further, even when the two types of titanium oxide particles are transferred to the carrier surface, the carrier surface is polished by the adhesive contained as the external additive, and thus a portion where the two types of titanium oxide particles are mixed can be removed.

Therefore, even when a high-density image is repeatedly formed, the electrostatic image developer according to the exemplary embodiment is supposed to suppress mixing of the two types of titanium oxide particles on the carrier surface and thus suppress image density unevenness.

(Toner)

The toner contains the toner particles.

The toner particles are configured to contain, for example, a binder resin, and if required, a coloring agent, a release agent, and other additives.

—Binder Resin—

Examples of the binder resin include vinyl resins composed of homopolymers of monomers or copolymers using a combination of two or more of these monomers, such as styrenes (for example, styrene, para-chlorostyrene, α-methylstyrene, and the like), (meth)acrylic acid esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, and the like), ethylenically unsaturated nitriles (for example, acrylonitrile, methacrylonitrile, and the like), vinyl ethers (for example, vinyl methyl ether, vinyl isobutyl ether, and the like), vinyl ketones (for example, vinyl methyl ketone, vinyl ethyl ketone, vinyl isopropenyl ketone, and the like), olefins (for example, ethylene, propylene, butadiene, and the like), and the like.

Other examples of the binder resin include non-vinyl resins such as epoxy resins, polyester resins, polyurethane resins, polyamide resins, cellulose resins, polyether resins, modified resins, and the like; mixtures of the non-vinyl resins and the vinyl resins or graft polymers produced by polymerizing the vinyl monomers in coexistence with these non-vinyl resins; and the like.

These binder resins may be used alone or in combination of two or more.

The binder resin is preferably a polyester resin.

Examples of the polyester resin include known polyester resins.

Examples of the polyester resin include a condensate of polyvalent carboxylic acid and polyhydric alcohol. In addition, the polyester resin used may be a commercial product or a synthetic product.

Examples of the polyvalent carboxylic acid include aliphatic dicarboxylic acids (for example, oxalic acid, malonic acid, maleic acid, fumaric acid, citraconic acid, itaconic acid, glutaconic acid, succinic acid, alkenylsuccinic acid, adipic acid, sebacic acid, and the like), alicyclic dicarboxylic acids (for example, cyclohexane dicarboxylic acid and the like), aromatic dicarboxylic acids (for example, terephthalic acid, isophthalic acid, phthalic acid, naphtharene dicarboxylic acid, and the like), and anhydrides or lower (for example, 1 or more and 5 or less carbon atoms) alkyl esters of these acids. Among these, for example, an aromatic dicarboxylic acid is preferred as the polyvalent carboxylic acid.

The polyvalent carboxylic acid may be a combination of dicarboxylic acid and tri- or higher-valent carboxylic acid having a crosslinked structure or branched structure. Examples of the tri- or higher-valent carboxylic acid include trimellitic acid, pyromellitic acid, anhydrides or lower (for example, 1 or more and 5 or less carbon atoms) alkyl esters of these acids, and the like.

The polyvalent carboxylic acids may be used alone or in combination of two or more.

Examples of the polyhydric alcohol include aliphatic diols (for example, ethylene glycol, diethylene glycol, triethylene glycol, propylene glycol, butanediol, hexanediol, neopentyl glycol, and the like), alicyclic diols (for example, cyclohexanediol, cyclohexanedimethanol, hydrogenated bisphenol A, and the like), and aromatic diols (for example, bisphenol A ethyl oxide adduct, bisphenol A propylene oxide adduct, and the like). Among these, a polyhydric alcohol is, for example, preferably an aromatic diol and an alicyclic diol, and more preferably an aromatic diol.

The polyhydric alcohol may be a combination of diol and tri- or higher-polyhydric alcohol having a crosslinked or branched structure. Examples of the tri- or higher-polyhydric alcohol include glycerin, trimethylolpropane, pentaerythritol, and the like.

The polyhydric alcohols may be used alone or in combination of two or more.

The glass transition temperature (Tg) of the polyester resin is preferably 50° C. or more and 80° C. or less and more preferably 50° C. or more and 65° C. or less.

The glass transition temperature (Tg) is determined from a DSC curve obtained by differential scanning calorimetry (DSC), and more specifically determined by "Extrapolated glass transition initiation temperature" described in "Determination of glass transition temperature" of JIS K 7121-1987 "Testing Methods for Transition Temperatures of Plastics".

The weight-average molecular weight (Mw) of the polyester resin is preferably 5,000 or more and 1,000,000 or less and more preferably 7,000 or more and 500,000 or less.

The number-average molecular weight (Mn) of the polyester resin is preferably 2,000 or more and 100,000 or less.

The molecular weight distribution Mw/Mn of the polyester resin is preferably 1.5 or more and 100 or less and more preferably 2 or more and 60 or less.

The weight-average molecular weight and number-average molecular weight are measured by gel permeation chromatography (GPC). The molecular weight is measured by GPC using GPC•HLC-8120GPC manufactured by Tosoh Corporation as a measurement apparatus, column TSK gel-Super HM-M (15 cm) manufactured by Tosoh Corporation, and THF solvent. The weight-average molecular weight and number-average molecular weight are calculated from the measurement results by using a molecular weight calibration curve formed by using a monodisperse polystyrene standard sample.

The polyester resin is produced by a known production method. Specifically, the polyester resin is produced by a method of reaction at a polymerization temperature of 180° C. or more and 230° C. or less, if required, under reduced pressure in the reaction system, while removing the water and alcohol generated during condensation.

When a monomer used as a raw material is insoluble or incompatible at the reaction temperature, a solvent having a high boiling point may be added as a solubilizing agent for dissolution. In this case, polycondensation reaction is performed while the solubilizing agent is distilled off. When a monomer having low compatibility is present, the monomer with low compatibility is previously condensed with an acid or alcohol to be polycondensed with the monomer and is then polycondensed together with a main component.

The content of the binder resin is, for example, preferably 40% by mass or more and 95% by mass or less, more preferably 50% by mass or more and 90% by mass or less, and still more preferably 60% by mass or more and 85% by mass or less, relative to the whole of the toner particles.

—Coloring Agent—

Examples of the coloring agent include various pigments such as carbon black, chrome yellow, hanza yellow, benzidine yellow, threne yellow, quinoline yellow, pigment yellow, permanent orange GTR, pyrazolone orange, vulcan orange, watch young red, permanent red, brilliant carmine 3B, brilliant carmine 6B, DuPont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, malachite green oxalate, and the like; various dyes such as acridine-based, xanthene-based, azo-based, benzoquinone-based, azine-based, anthraquinone-based, thioindigo-based, dioxazine-based, thiazine-based, azomethine-based, indigo-based, phthalocyanine-based, aniline black-based, polymethine-based, triphenylmethane-based, diphenylmethane-based, and thiazole-based dyes, and the like.

The coloring agents may be used alone or in combination of two or more.

If required, the coloring agent may be surface-treated or may be used in combination with a dispersant. In addition, plural types of coloring agents may be combined.

The content of the coloring agent is, for example, preferably 1% by mass or more and 30% by mass or less and more preferably 3% by mass or more and 15% by mass or less, relative to the whole of the toner particles.

—Release Agent—

Examples of the release agent include natural waxes such as hydrocarbon wax, carnauba wax, rice wax, candelilla wax, and the like; synthetic or mineral/petroleum waxes such as montan wax and the like; ester-based waxes such as fatty acid esters, montanic acid esters, and the like; and the like. The release agent is not limited to these.

The melting temperature of the release agent is preferably 50° C. or more 110° C. or less and more preferably 60° C. or more 100° C. or less.

The melting temperature of the release agent is determined from a DSC curve obtained by differential scanning calorimetry (DSC) according to "Melting peak temperature" described in "Method of obtaining a melting temperature" in JIS K 7121-1987 "Testing Methods for Transition Temperatures of Plastics".

The content of the release agent is, for example, preferably 1% by mass or more and 20% by mass or less and more preferably 5% by mass or more and 15% by mass or less, relative to the whole of the toner particles.

—Other Additives—

Examples of other additive include known additives such as a magnetic material, a charge control agent, an inorganic powder, and the like. These additives are contained as an internal additive in the toner particles.

—Characteristics Etc. of Toner Particles—

The toner particles may be toner particles having a single-layer structure or toner particles having a so-called core-shell structure configured by a core part (core particles) and a coating layer (shell layer) which coats the core part.

The toner particles having a core-shell structure are preferably configured by, for example, the core part configured to contain the binder resin and, if required, the other additive such as the coloring agent, the release agent, etc., and the coating layer configured to contain the binder resin.

The volume-average particle diameter (D50v) of the toner particles is preferably 2 μm or more and 10 μm or less and more preferably 4 μm or more and 8 μm or less.

Various average particle diameters and various particle size distribution indexes of the toner particles are measured by using Coulter Multisizer II (manufactured by Beckman Coulter, Inc.) and electrolytic solution ISOTON-II (manufactured by Beckman Coulter, Inc.).

In the measurement, 0.5 mg or more and 50 mg or less of a measurement sample is added to 2 ml of a 5% aqueous solution of a surfactant (preferably, sodium alkylbenzenesulfonate) as a dispersant. The resultant mixture is added to 100 ml or more and 150 ml or less of the electrolytic solution.

The electrolytic solution in which the sample has been suspended is dispersed by using an ultrasonic disperser for 1 minute, and the particle size distribution of particles having particle diameters within a range of 2 μm or more and 60 μm or less is measured by Coulter Multisizer II using an aperture having an aperture diameter of 100 μm. The number of particles sampled is 50,000.

Based on the measured particle size distribution, each of volume-based and number-based cumulative distributions is drawn vs. divided particle size ranges (channels) from the small diameter side. In the cumulative distributions, the particle diameters at 16% cumulation are defined as the volume particle diameter D16v and the number particle diameter D16p, the particle diameters at 50% cumulation are defined as the volume-average particle diameter D50v and the cumulative number-average particle diameter D50p, and the particle diameters at 84% cumulation are defined as the volume particle diameter D84v and the number particle diameter D84p.

By using these diameters, the volume particle size distribution index (GSDv) is calculated as $(D84v/D16v)^{1/2}$, and the number particle size distribution index (GSDp) is calculated as $(D84p/D16p)^{1/2}$.

The average circularity of the toner particles is preferably 0.94 or more 1.00 or less and more preferably 0.95 or more and 0.98 or less.

The average circularity of the toner particles is determined by (equivalent circle circumference length)/circumference length) [(circumference length of a circle having the same projection area as a particle image)/(circumference length of particle projection image)]. Specifically, the average circularity is a value measured by the following method.

First, the toner particles to be measured are suction-sampled to form a flat flow, and a particle image is instantly captured as a still image by strobe light emission. The average circularity is determined by image analysis of the particle image by using a flow particle image analyzer (FPIA-3000 manufactured by Sysmex Corporation). The number of particles sampled for determining the average circularity is 3500.

When the toner contains an external additive, the toner (developer) to be measured is dispersed in water containing a surfactant and then ultrasonically treated, producing the toner particles from which the external additive has been removed.

(Carrier)

The carrier is not particularly limited, and a known carrier can be used. Examples of the carrier include a coated carrier including a core material composed of a magnetic powder and having a surface coated with a coating resin; a magnetic powder-dispersed carrier including a matrix resin in which a magnetic powder is dispersed/mixed; a resin-impregnated carrier including a porous magnetic powder impregnated with a resin; and the like.

The magnetic powder-dispersed carrier and the resin-impregnated carrier may be a carrier including constituent particles as a core material, which is coated with a coating resin.

Examples of the magnetic powder include magnetic metals such as iron, nickel, cobalt, and the like; magnetic oxides such as ferrite, magnetite, and the like; and the like.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymer, styrene-acrylic acid ester copolymer, straight silicone resin containing organosiloxane bond or modified products thereof, fluorocarbon resins, polyester, polycarbonate, phenol resins, epoxy resins, and the like.

The coating resin and the matrix resin may contain other additives such as conductive particles and the like.

Examples of the conductive particles include particles of metals such as gold, silver, copper, and the like, carbon black, titanium oxide, zinc oxide, tin oxide, barium sulfate, aluminum borate, potassium titanate, and the like.

The surface of the core material is coated with the coating resin by, for example, a method of coating with a solution for forming a coating layer, which is prepared by dissolving the coating resin and, if required, various additives in a proper solvent. The solvent is not particularly limited and may be selected in consideration of the coating resin used, coatability, etc.

Examples of the resin coating method include an immersion method of immersing the core material in the solution for forming a coating layer, a spray method of spraying the solution for forming a coating layer on the surface of the core material, a fluidized bed method of spraying the solution for forming a coating layer on the core material in a state of being floated by flowing air, a kneader-coater method of mixing the core material of the carrier with the solution for forming a coating layer in a kneader-coater and removing the solvent, and the like.

The mixing ratio (mass ratio) of the toner to the carrier in the two-component developer is preferably toner:carrier=1:100 to 30:100 and more preferably 3:100 to 20:100.

(External Additive)

The external additive contains the titanium dioxide particles of two types having different refractive indexes or crystallite diameters, the fatty acid metal salt particles, and the abrasive.

—Titanium Dioxide Particles—

The titanium dioxide particles of two types having different refractive indexes or crystallite diameters are used as titanium dioxide particles.

The surfaces of the titanium dioxide particles are preferably hydrophobilized. The hydrophobilization treatment is performed by, for example, immersing the titanium dioxide particles in a hydrophobilization treatment agent. Examples of the hydrophobilization treatment agent include, but are not particularly limited to, a silane coupling agent, silicone oil, a titanate-based coupling agent, an aluminum-based coupling agent, and the like. These may be used alone or in combination of two or more.

The amount of the hydrophobilization treatment agent is, for example, 1 part by mass or more and 10 parts by mass or less relative to 100 parts by mass of the titanium dioxide particles.

The number-average particle diameter of the titanium dioxide particles is preferably 0.01 μm or more and 10 μm or less and more preferably 0.02 μm or more and 5 μm or less.

With respect to the number-average particle diameter of the titanium dioxide particles, an image of the toner, to which the external additive containing the titanium dioxide particles has been externally added, is photographed at a magnification of 40000 times by using a scanning electron microscope (SEM) (S-4700 manufactured by Hitachi High-Technologies Corporation) and observed at an acceleration voltage of 15 kV, an emission current of 20 μA, and WD 15 mm. The equivalent circular diameters of specified silica particles are determined by analysis using image processing analysis software WinRoof (manufactured by Mitani Corporation). The particle diameters (equivalent circle diameters) of at least 100 particles are measured, and the particle diameter at 50% cumulation from the small particle diameter side in the number-based distributions of particle diameters is determined as the number-average particle diameter.

In image analysis for determining the equivalent circle diameters of 100 titanium dioxide particles to be measured, a two-dimensional image is photographed at a magnification of 10,000 times by using an analyzer (ERA-8900, manufactured by Elionix Inc.), and the projection area is determined by using image analysis software WinRoof (manufactured by Mitani Corporation) under the condition of 0.010000 μm/pixel. The equivalent circle diameter is determined by the formula: Equivalent circle diameter=2√(projection area/π).

From the viewpoint of suppressing image density unevenness, the titanium dioxide particles of two types having different refractive indexes include titanium dioxide particles (A) adhering to the toner particles and titanium dioxide particles (B) adhering to the carrier, and the refractive index of the titanium dioxide particles (A) is preferably lower than the refractive index of the titanium dioxide particles (B).

The reason whey image density unevenness is suppressed by the configuration in which the refractive indexes of the titanium dioxide particles (A) and the titanium dioxide particles (B) are as described above is supposed as follows.

The titanium dioxide particles (A) having a lower refractive index are supposed to tend to have high negative polarity as compared with the titanium dioxide particles (B) having a high refractive index. When the titanium dioxide particles (B) are adhered to the carrier and the titanium dioxide particles (A) are adhered to the surfaces of the toner particles, a proper potential difference occurs between the toner and the carrier, thereby improving charging characteristics.

Also, the fatty acid metal salt particles contained as the external additive have positive polarity. Therefore, the titanium dioxide particles (A) having high negative polarity are preferentially adhered to the fatty acid metal salt particles by electrostatic interaction. This suppresses mixing of the titanium dioxide particles (A) and the titanium dioxide particles (B) on the carrier surface. Even when the titanium dioxide particles (A) and the titanium dioxide particles (B) are mixed on the carrier surface, the surface is polished by the abrasive contained as the external additive.

That is, a partial decrease in charge exchangeability, which is caused by mixing of the two types of titanium oxide particles on the carrier surface, can be more suppressed.

Therefore, image density unevenness is supposed to be suppressed.

From the viewpoint of suppressing image density unevenness, a difference in refractive index between the titanium dioxide particles (A) and the titanium dioxide particles (B) is preferably 0.1 or more and 0.8 or less, more preferably 0.2 or more and 0.6 or less, and still more preferably 0.2 or more and 0.4 or less.

The refractive index of the titanium dioxide particles (A) is preferably 2.0 or more and less than 2.4, more preferably 2.1 or more and less than 2.4, and still more preferably 2.2 or more and less than 2.4.

The refractive index of the titanium dioxide particles (B) is preferably 2.4 or more and 2.8 or less, more preferably 2.6 or more and 2.8 or less, and still more preferably 2.6 or more and 2.7 or less.

When the refractive index of the titanium dioxide particles (A) is 2.0 or more, it is preferred because excessive charging of the toner is easily suppressed.

When the refractive index of the titanium dioxide particles (A) is less than 2.4, it is preferred because the toner is easily caused to have a charge potential required for development.

When the refractive index of the titanium dioxide particles (A) is 2.0 or more and less than 2.4, it is preferred because image density unevenness is suppressed.

When the refractive index of the titanium dioxide particles (B) is 2.4 or more, it is preferred because excessive charging of the toner is easily suppressed.

When the refractive index of the titanium dioxide particles (B) is 2.8 or less, it is preferred because the toner is easily caused to have a charge potential required for development.

When the refractive index of the titanium dioxide particles (B) is 2.4 or more and 2.8 or less, it is preferred because image density unevenness is suppressed.

In measuring the refractive index of titanium dioxide particles, first, the toner or developer is ultrasonically treated, and titanium dioxide particles having high specific gravity are separated from the resultant external additive by a centrifugal separator. The refractive index of the resultant titanium dioxide particles Is measured by, for example, the measurement method described in JIS K 7142 (2014).

The titanium dioxide particles of two types having different crystallite diameters include the titanium dioxide particles (A) adhering to the toner particles and the titanium dioxide particles (B) adhering to the carrier, and the crystallite diameter of the titanium dioxide particles (B) is preferably larger than the crystallite diameter of the titanium dioxide particles (A).

The reason why image density unevenness is suppressed by the configuration in which the crystallite diameters of the titanium dioxide particles (A) and the titanium dioxide particles (B) are as described above is supposed as follows.

The titanium dioxide particles (B) having a larger crystallite diameter are supposed to tend to have high conductivity and low chargeability as compared with the titanium dioxide particles (A) having a smaller crystallite diameter. When the titanium dioxide particles (B) are adhered to the toner and the titanium dioxide particles (A) are adhered to the carrier surface, a proper potential difference occurs between the toner and the carrier, thereby improving charging characteristics.

Also, the fatty acid metal salt particles contained as the external additive have positive polarity. Therefore, the titanium dioxide particles (B) having high conductivity and low chargeability are preferentially adhered to the fatty acid metal salt particles by electrostatic interaction. This suppresses transfer of the titanium dioxide particles (B) to the carrier surface. Even when the titanium dioxide particles (B) are transferred to the carrier surface, the surface is polished by the abrasive contained as the external additive, thereby increasing the ratio of the titanium dioxide particles (A) present on the carrier surface.

That is, a partial decrease in charge exchangeability, which is caused by mixing of the two types of titanium oxide particles on the carrier surface, can be more suppressed.

Therefore, image density unevenness is supposed to be suppressed.

From the viewpoint of suppressing image density unevenness, a difference (absolute value) in crystallite diameter between the titanium dioxide particles (A) and the titanium dioxide particles (B) is preferably 24 nm or more and 32 nm or less, more preferably 25 nm or more and 31 nm or less, and still more preferably 26 nm or more and 30 nm or less.

The crystallite diameter of the titanium dioxide particles (A) is preferably 12 nm or more and less than 16 nm, more preferably 13 nm or more and less than 15 nm, and still more preferably 14 nm or more and less than 15 nm.

The crystallite diameter of the titanium dioxide particles (B) is preferably 40 nm or more and 44 nm or less, more preferably 41 nm or more and 43 nm or less, and still more preferably 42 nm or more and 43 nm or less.

When the crystallite diameter of the titanium dioxide particles (A) is 12 nm or more, it is preferred because excessive charging of the toner is easily suppressed.

When the crystallite diameter of the titanium dioxide particles (A) is less than 16 nm, it is preferred because the toner is easily caused to have a charge potential required for development.

When the crystallite diameter of the titanium dioxide particles (A) is 12 nm or more and less than 16 nm, it is preferred because image density unevenness is suppressed.

When the crystallite diameter of the titanium dioxide particles (B) is 40 nm or more, it is preferred because excessive charging of the toner is easily suppressed.

When the crystallite diameter of the titanium dioxide particles (B) is 44 nm or less, it is preferred because the toner is easily caused to have a charge potential required for development.

When the crystallite diameter of the titanium dioxide particles (B) is 40 nm or more and 44 nm or less, it is preferred because image density unevenness is suppressed.

In the present exemplary embodiment, the term "crystallite" represents each of the individual single crystals constituting a polycrystal or a single crystal observed in an amorphous material.

In addition, the term "crystallite diameter" represents the average diameter of crystallites with the minimum unit constituting a crystal.

In the exemplary embodiment of the present disclosure, the method for measuring the crystallite diameter of the titanium dioxide particles is as follows.

In the exemplary embodiment of the present disclosure, the crystallite diameter is determined as follows.

An object crystal is measured by using an X-ray diffractometer, and the crystallite diameter is determined by the following Scherrer's equation.

$$D=K\times\lambda/(\beta\times\cos\theta)$$

D: crystallite diameter (nm)

K: Scherrer constant

λ: X-ray wavelength

β: diffraction line broadening

θ: diffraction angle (2θ/θ)

Preferably, the crystal structure of the titanium dioxide particles (A) is of anatase type, and the crystal structure of the titanium dioxide particles (B) is of rutile type.

From the viewpoint of suppressing image density unevenness, the content of the titanium dioxide particles (A) relative to the content of the titanium dioxide particles (B) is preferably 0.1% by mass or more and 50% by mass or less, more preferably 0.1% by mass or more and 25% by mass or less, still more preferably 0.4% by mass or more and 1% by mass or less, and most preferably 0.5% by mass or more and 0.6% by mass or less.

The total content of the titanium dioxide particles (A) and the titanium dioxide particles (B) relative to the total mass of the electrostatic image developer is preferably 0.1% by mass or more and 0.8% by mass or less, more preferably 0.2% by mass or more and 0.6% by mass or less, and still more preferably 0.2% by mass or more and 0.4% by mass or less.

—Fatty Acid Metal Salt Particles—

The fatty acid metal salt particles are particles of a salt composed of a fatty acid and a metal and have positive chargeability.

The fatty acid may be either a saturated fatty acid or an unsaturated fatty acid. The fatty acid is, for example, a fatty acid having 10 or more and 25 or less (preferably 12 or more and 22 or less) carbon atoms. The number of carbon atoms of the fatty acid includes that of carbon of a carboxyl group.

Examples of the fatty acid include saturated fatty acids such as behenic acid, stearic acid, palmitic acid, myristic acid, lauric acid, and the like; and unsaturated fatty acids such as oleic acid, linoleic acid, ricinoleic acid, and the like. Among these fatty acids, from the viewpoint of suppressing image density unevenness, stearic acid and lauric acid are preferred, and stearic acid is more preferred.

The metal is preferably a divalent metal. Examples of the metal include magnesium, calcium, aluminum, barium, and zinc. Among these, from the viewpoint of suppressing image density unevenness, the metal is preferably zinc.

Examples of the fatty acid metal salt particles include particles of stearic acid metal salts such as aluminum stearate, calcium stearate, potassium stearate, magnesium stearate, barium stearate, lithium stearate, zinc stearate, copper stearate, lead stearate, nickel stearate, strontium stearate, cobalt stearate, sodium stearate, and the like; palmitic acid metal salts such as zinc palmitate, cobalt palmitate, copper palmitate, magnesium palmitate, aluminum palmitate, calcium palmitate, and the like; lauric acid metal salts such as zinc laurate, manganese laurate, calcium laurate, iron laurate, magnesium laurate, aluminum laurate, and the like; oleic acid metal salts such as zinc oleate, manganese oleate, iron oleate, aluminum oleate, copper oleate, magnesium oleate, calcium oleate, and the like; linoleic acid metal salts such as zinc linoleate, cobalt linoleate, calcium linoleate, and the like; ricinoleic acid metal salts such as zinc ricinolate, aluminum ricinolate, and the like; and the like.

Among these, from the viewpoint of suppressing image density unevenness, the fatty acid metal salt particles are preferably fatty acid zinc salt particles, more preferably zinc stearate particles or zinc laurate particles, and still more preferably zinc stearate particles.

Examples of the method for producing the fatty acid metal salt particles include, but are not particularly limited to, a method of cation substitution of a fatty acid alkali metal salt, a method of directly reacting a fatty acid with metal hydroxide, and the like.

Examples of the method for producing zinc stearate particles as an example of the fatty acid metal salt particles include a method of cation substitution of sodium stearate, a method of reacting stearic acid with zinc hydroxide, and the like.

The number-average particle diameter of the fatty acid metal salt particles is preferably 0.5 μm or more and 3.0 μm or less and more preferably 1.0 μm or more and 2.5 μm or less.

The number-average particle diameter of the fatty acid metal salt particles is the value measured by the following method.

The developer is dispersed in an aqueous solution prepared by adding a surfactant to water adjusted to a specific gravity of 1.5 or more and 2.0 or less by adding potassium iodide or the like. Then, the dispersion is allowed to stand for 24 hours, whereby the toner particles and the fatty acid metal salt particles, which have a lower specific gravity than that of the aqueous solution, are separated in an upper portion of the aqueous solution and the carrier, the titanium dioxide particles, and the abrasive, which have a higher specific gravity than that of the aqueous solution, are precipitated in a lower portion of the aqueous solution. The toner particles and the fatty acid metal salt particles separated in the upper portion of the aqueous solution are collected, and a sample obtained by drying the collected liquid at room temperature (25° C.) is observed by SEM. The particles with a particle diameter of 0.1 μm or more, excluding the toner particles, are considered as the fatty acid metal salt particles.

Then, the equivalent circle diameters of each of 100 of the fatty acid metal salt particles to be measured is determined by image analysis, and the equivalent circle diameter at 50% cumulation of number of particles (50th particle) from the small particle diameter side in the number-based distribution is regarded as the number-average particle diameter.

In image analysis for determining the equivalent circle diameters of 100 fatty acid metal salt particles to be measured, a two-dimensional image is photographed at a magnification of 10,000 times by using an analyzer (ERA-8900, manufactured by Elionix Inc.), and the projection area is determined by using image analysis software WinRoof (manufactured by Mitani Corporation) under the condition of 0.010000 μm/pixel. The equivalent circle diameter is determined by the formula: Equivalent circle diameter=2√(projection area/π).

In addition, when fatty acid metal salt particles are separately obtained or collected from the developer, the fatty acid metal salt particles obtained or collected are used as a measurement object and measured as described above.

From the viewpoint of suppressing image density unevenness, the content of the fatty acid metal salt particles relative to the content of the titanium dioxide particles (B) is preferably 1% by mass or more and 10% by mass or less, more preferably 2% by mass or more and 9% by mass or less, and still more preferably 3% by mass or more and 8% by mass or less.

When the content of the fatty acid metal salt particles is 1% by mass or more relative to the content of the titanium dioxide particles (B), it is preferred because transfer of the titanium dioxide particles (B) to the carrier surface is suppressed.

When the content of the fatty acid metal salt particles is 10% by mass or less relative to the content of the titanium dioxide particles (B), it is preferred because the toner is easily caused to have a charge potential required for development.

The content of the fatty acid metal salt particles relative to the toner particles is preferably 0.01% by mass or more and 0.5% by mass or less, more preferably 0.02% by mass or more and 0.1% by mass or less, and still more preferably 0.03% by mass or more and 0.06% by mass or less.

—Abrasive—

Examples of the abrasive include, but are not particularly limited to, inorganic particles such as particles of metal oxides other than titanium dioxide and silica, such as cerium oxide, magnesium oxide, aluminum oxide (alumina), zinc oxide, zirconia, and the like; carbides such as silico carbide and the like; nitrides such as boron nitride and the like; pyrophosphoric acid salts such as calcium pyrophosphate particles and the like; carbonic acid salts such as calcium carbonate, barium carbonate, and the like; titanic acid metal salts such as barium titanate, magnesium titanate, calcium titanate, strontium titanate, and the like; and the like. The abrasives may be used alone or in combination of two or more. Among these, from the viewpoint of suppressing image density unevenness, the abrasive preferably includes titanic acid metal salt particles and more preferably strontium titanate particles.

The surface of abrasive may be hydrophobilized by, for example, a hydrophobilization treatment agent. The hydrophobilization treatment agent is, for example, a known organic silicon compound having an alkyl group (for example, a methyl group, an ethyl group, a propyl group, a butyl group, or the like). Specific examples thereof include silazane compounds (for example, silane compounds such as methyl trimethoxysilane, dimethyl dimethoxysilane, trimethyl chlorosilane, trimethyl methoxysilane, and the like, hexamethyl disilazane, tetramethyl disilazane, and the like), and the like. The hydrophobilization treatment agents may be used alone or in combination of two or more.

From the viewpoint of suppressing image density unevenness, the number-average particle diameter of the abrasive is preferably 0.5 μm or more and 5.0 μm or less, more preferably 0.5 μm or more and 3.0 μm or less, and still more preferably 0.5 μm or more and 2.0 μm or less.

The number-average particle diameter of the abrasive is the value measured by the following method.

The developer is dispersed in an aqueous solution prepared by adding a surfactant to water adjusted to a specific gravity of 1.5 or more and 2.0 or less by adding potassium iodide or the like. Then, the dispersion is allowed to stand for 24 hours, whereby the toner particles and the fatty acid metal salt particles, which have a smaller specific gravity than that of the aqueous solution, are separated in an upper portion of the aqueous solution and the carrier, the titanium dioxide particles, and the abrasive, which have a larger specific gravity than that of the aqueous solution, are precipitated in a lower portion of the aqueous solution. The carrier, the titanium dioxide particles, and the abrasive precipitated in the lower portion of the aqueous solution are collected, and a sample obtained by drying the collected liquid at room temperature (25° C.) is observed by SEM. The particles with a particle diameter of 0.1 μm or more, excluding the carrier and the titanium dioxide particles, are considered as the abrasive.

Then, the equivalent circle diameter of each of 100 particles of the abrasive to be measured is determined by image analysis, and the equivalent circle diameter at 50% cumulation of number of particles (50th particle) from the small diameter side in the number-based distribution is regarded as the number-average particle diameter.

In image analysis for determining the equivalent circle diameters of 100 abrasive particles to be measured, a two-dimensional image is photographed at a magnification of 10,000 times by using an analyzer (ERA-8900, manufactured by Elionix Inc.), and the projection area is determined by using image analysis software WinRoof (manufactured by Mitani Corporation) under the condition of 0.010000 μm/pixel. The equivalent circle diameter is determined by the formula: Equivalent circle diameter=2√(projection area/π).

In addition, when an abrasive is separately obtained or collected from the developer, the abrasive obtained or collected is used as a measurement object and measured as described above.

The content of the abrasive relative to the content of the titanium dioxide particles (A) is preferably 1% by mass or more and 10% by mass or less, more preferably 2% by mass or more and 9% by mass or less, and still more preferably 3% by mass or more and 7% by mass or less.

When the content of the abrasive is 1% by mass or more relative to the content of the titanium dioxide particles (A), it is preferred because mixing of the two types of titanium dioxide particles on the carrier surface is suppressed.

When the content of the abrasive is 10% by mass or less relative to the content of the titanium dioxide particles (A), it is preferred because the toner is easily brought to a charge level required for development.

The content of the abrasive relative to the total mass of the electrostatic image developer is preferably 0.0001% by mass or more and 0.005% by mass or less, more preferably 0.0002% by mass or more and 0.001% by mass or less, and still more preferably 0.0003% by mass or more and 0.0006% by mass or less.

—Other External Additives—

Another external additive other than the titanium dioxide particles, the fatty acid metal salt particles, and the abrasive may be contained as the external additive.

Examples of the other external additive include inorganic particles (also referred to as "small-diameter inorganic particles" hereinafter) having a number-average particle diameter of 1 μm or less (preferably 500 nm or less). The number-average particle diameter of the small-diameter inorganic particles is the value measured by the same method as of the number-average particle diameter of the abrasive particles.

Examples of the small-diameter inorganic particles include those of $SiO_2$, CuO, $SnO_2$, $Fe_2O_3$, BaO, CaO, $K_2O$, $Na_2O$, $CaO.SiO_2$, $K_2O.(TiO_2)n$, $Al_2O_3.2SiO_2$, $MgCO_3$, $BaSO_4$, $MgSO_4$, and the like.

The surfaces of the small-diameter inorganic particles added as the external additive are preferably hydrophobilized. The hydrophobilization treatment is performed by, for example, immersing the inorganic particles in a hydrophobilization treatment agent. Examples of the hydrophobilization treatment agent include, but are not particularly limited to, a silane coupling agent, silicone oil, a titanate-based coupling agent, an aluminum-based coupling agent, and the like. These may be used alone or in combination of two or more.

The amount of the hydrophobilization treatment agent is, for example, 1 part by mass or more and 10 parts by mass or less relative to 100 parts by mass of the small-diameter inorganic particles.

Other examples of the external additive include resin particles (resin particles of polystyrene, polymethyl methacrylate (PMMA), melamine, and the like), a cleaning activator (for example, fluorine-based polymer particles), and the like.

The amount of the other additive externally added relative to the toner particles is, for example, 0.01% by mass or more and 5% by mass or less and more preferably 0.01% by mass or more and 2.0% by mass or less.

<Image Forming Apparatus/Image Forming Method>

An image forming apparatus/image forming method according to an exemplary embodiment of the present disclosure is described.

An image forming apparatus according to an exemplary embodiment of the present disclosure includes an image holding member, a charging unit which charges the surface of the image holding member, an electrostatic image forming unit which forms an electrostatic image on the charged surface of the image holding member, a developing unit which contains an electrostatic image developer and develops, as a toner image with the electrostatic image developer, the electrostatic image formed on the surface of the image holding member, a transfer device which transfers the toner image formed on the surface of the image holding member to the surface of a recording medium, and a fixing unit which fixes the toner image transferred to the surface of the recording medium. The electrostatic image developer according to the exemplary embodiment is applied as the electrostatic image developer.

The image forming apparatus according to the exemplary embodiment performs an image forming method (an image forming method according to an exemplary embodiment of the present disclosure) including charging the surface of the image holding member, forming an electrostatic image on the charged surface of the image holding member, developing, as a toner image with the electrostatic image developer according to the exemplary embodiment of the present disclosure, the electrostatic image formed on the surface of the image holding member, transferring the toner image formed on the surface of the image holding member to the surface of a recording medium, and fixing the toner image transferred to the surface of the recording medium.

Examples of apparatuses applied to the image forming apparatus according to the exemplary embodiment include known image forming apparatuses such as an apparatus of a direct transfer system in which a toner image formed on the surface of an image holding member is transferred directly to a recording medium; an apparatus of an intermediate transfer system in which a toner image formed on the surface of an image holding member is first transferred to an intermediate transfer body, and the toner image transferred to the intermediate transfer body is second transferred to the surface of a recording medium; an apparatus provided with a cleaning unit which cleans the surface of an image holding member before charging and after transfer of the toner image; an apparatus provided with a static elimination unit which eliminates static electricity by irradiation with elimination light before charging and after transfer of the toner image; and the like.

In the case of the apparatus of an intermediate transfer system, a configuration applied to a transfer unit includes, for example, an intermediate transfer body with a surface to which a toner image is transferred, a first transfer unit which first transfers the toner image formed on the surface of an image holding member to the surface of the intermediate transfer body, and a second transfer unit which second transfers the toner image transferred to the surface of the intermediate transfer body to the surface of a recording medium.

In the image forming apparatus according to the exemplary embodiment of the present disclosure, for example, a part including the developing unit may have a cartridge structure (process cartridge) detachable from the image forming apparatus. A process cartridge provided with a developing unit which contains the electrostatic image developer according to the exemplary embodiment is preferably used as the process cartridge.

An example of the image forming apparatus according to the exemplary embodiment is described below, but the image forming apparatus is not limited to this. Description is made of principal parts shown in the drawings, and the description of parts are is omitted.

FIG. 1 is a schematic configuration diagram showing the image forming apparatus according to the exemplary embodiment of the present disclosure.

The image forming apparatus shown in FIG. 1 includes first to fourth electrophotographic image forming units 10Y, 10M, 10C, and 10K (image forming units) which output images of the colors of yellow (Y), magenta (M), cyan (C), and black (K), respectively, based on color-separated image data. The image forming units (may be simply referred to as the "units" hereinafter) 10Y, 10M, 10C, and 10K are disposed in parallel to be spaced from each other by a predetermined distance in a horizontal direction. Each of the units 10Y, 10M, 10C, and 10K may be a process cartridge detachable from the image forming apparatus.

An intermediate transfer belt 20 is extended as the intermediate transfer body in upper portions of the units 10Y, 10M, 10C, and 10K in the drawing so as to pass through the units. The intermediate transfer belt 20 is provided to be wound on a drive roll 22 and a support roll 24 in contact with the inner surface of the intermediate transfer belt 20, the drive roll 22 and the support roll 24 being disposed to be separated from each other in the lateral direction in the drawing, so that the intermediate transfer belt 20 is moved in the direction from the first unit 10Y to the fourth unit 10K. In addition, a force is applied to the support roll 24 from a spring or the like (not shown) in a direction of separating from the drive roll 22, thereby applying tension to the intermediate transfer belt 20 wound on both rolls. In addition, an intermediate transfer body cleaning device 30 is provided on the image holding member-side surface of the intermediate transfer belt 20 so as to face the drive roll 22.

Also, toners containing the four color toners of yellow, magenta, cyan, and black, which are contained in toner cartridges 8Y, 8M, 8C, and 8K, are supplied to developing devices (developing units) 4Y, 4M, 4C, and 4K of the units 10Y, 10M, 10C, and 10K, respectively.

The first to fourth units 10Y, 10M, 10C, and 10K have equivalent configurations and thus the first unit 10Y which forms a yellow image and disposed on the upstream side in the movement direction of the intermediate transfer belt is described as a representative. In addition, the description of the second to fourth units 10M, 10C, and 10K is omitted by applying reference numerals with magenta (M), cyan (C), and black (K), respectively, in place of yellow (Y) to parts equivalent to those in the first unit 10Y.

The first unit 10Y has a photoreceptor 1Y functioning as the image holding member. Around the photoreceptor 1Y, there are sequentially provided a charging roller (an example of the charging unit) 2Y which charges the surface of the photoreceptor 1Y to a predetermined potential, an exposure device (an example of the electrostatic image forming unit) 3 which forms an electrostatic image by exposure of the charged surface with a laser beam 3Y based on an image signal obtained by color separation, a developing device (an example of the developing unit) 4Y which develops the electrostatic image by supplying the charged toner to the electrostatic image, a first transfer roller (an example of the first transfer unit) 5Y which transfers the developed toner image to the intermediate transfer belt 20, and a photoreceptor cleaning device (an example of the cleaning unit) 6Y which removes the toner remaining on the surface of the photoreceptor 1Y after first transfer.

The first transfer roller 5Y is disposed on the inside of the intermediate transfer belt 20 and is provided at a position facing the photoreceptor 1Y. Further, a bias power supply (not shown) is connected to each of the first transfer rollers 5Y, 5M, 5C, and 5K in order to apply a first transfer bias thereto. The transfer bias applied to each of the first transfer rollers from the bias power supply can be changed by control of a controller (not shown).

The operation of forming a yellow image in the first unit 10Y is described below.

First, before the operation, the surface of the photoreceptor 1Y is charged to a potential of −600 V to −800 V by the charging roller 2Y.

The photoreceptor 1Y is formed by laminating a photosensitive layer on a conductive (for example, a volume resistivity of $1\times10^{-6}$ Ωcm or less at 20° C.) substrate. The photosensitive layer generally has high resistance (the resistance of a general resin) and has the property that when irradiated with a laser beam, the resistivity of a portion irradiated with the laser beam is changed. Thus, a laser beam 3Y is output to the charged surface of the photoreceptor 1Y through the exposure device 3 according to yellow image data sent from the controller (not shown). The photosensitive layer on the surface of the photoreceptor 1Y is irradiated with the laser beam 3Y, thereby forming an electrostatic image in a yellow image pattern on the surface of the photoreceptor 1Y.

The electrostatic image is an image formed on the surface of the photoreceptor 1Y by charging and is a so-called negative latent image formed by the laser beam 3Y, which causes the electrostatic charge flowing in the surface of the photoreceptor 1Y due to a decrease in resistivity of the irradiated portion of the photosensitive layer while the charge in a portion not irradiated with the laser beam 3Y remains.

The electrostatic image formed on the photoreceptor 1Y is rotated to a predetermined development position with travel of the photoreceptor 1Y. Then, at the development position, the electrostatic image on the photoreceptor 1Y is visualized (developed) as a toner image by the developing device 4Y.

For example, the electrostatic image developer containing at least the yellow toner and the carrier is contained in the developing device 4Y. The yellow toner is frictionally charged by stirring in the developing device 4Y and thus has a charge with the same polarity (negative polarity) as that of the electrostatic charge on the photoreceptor 1Y and is held on the developer roller (an example of the developer holding body). When the surface of the photoreceptor 1Y is passed through the developing device 4Y, the yellow toner electrostatically adheres to an electrostatically eliminated latent image on the surface of the photoreceptor 1Y, developing the latent image with the yellow toner. Then, the photoreceptor 1Y on which the yellow toner image has been formed is continuously traveled at a predetermined speed, and the toner image developed on the photoreceptor 1Y is transported to a predetermined first transfer position.

When the yellow toner image on the photoreceptor 1Y is transported to the first transfer position, the first transfer bias is applied to the first transfer roller 5Y, and electrostatic force to the first transfer roller 5Y from the photoreceptor 1Y is applied to the toner image. Thus, the toner image on the photoreceptor 1Y is transferred to the intermediate transfer belt 20. The transfer bias applied has a polarity (+) opposite to the polarity (−) of the toner and is controlled in the first unit 10Y to, for example, +10 μA by the controller (not shown).

On the other hand, the toner remaining on the photoreceptor 1Y is removed by the photoreceptor cleaning device 6Y and recovered.

The first transfer bias applied to each of the first transfer rollers 5M, 5C, and 5K of the second unit 10M and the later units is controlled according to the first unit 10Y.

Then, the intermediate transfer belt 20 to which the yellow toner image has been transferred in the first unit 10Y is sequentially transported through the second to fourth units 10M, 10C, and 10K to superpose the toner images of the respective colors by multi-layer transfer.

The intermediate transfer belt 20 to which the four color toner images have been transferred in multiple layers through the first to fourth units is reached to a second transfer part configurated by the intermediate transfer belt 20, the support roller 24 in contact with the inner side of the intermediate transfer belt 20, and the second transfer roller (an example of the second transfer unit) 26 disposed on the image holding surface side of the intermediate transfer belt 20. Meanwhile, recording paper (an example of the recording medium) P is fed with predetermined timing, through a feeding mechanism, to a space in which the second transfer roller 26 is in contact with the intermediate transfer belt 20, and a second transfer bias is applied to the support roller 24. The applied transfer bias has the same polarity (−) as the polarity (−) of the toner and electrostatic force acting toward the recording paper P from the intermediate transfer belt 20 is applied to the toner image to transfer the toner image on the intermediate transfer belt 20 to the recording paper P. In this case, the second transfer bias is determined according to the resistance detected by a resistance detecting unit (not shown) which detects the resistance of the second transfer part and is voltage-controlled.

Then, the recording paper P is transported to a pressure-contact part (nip part) of a pair of fixing rollers in the fixing device (an example of the fixing unit) 28, and the toner image is fixed to the recording paper P, forming a fixed image.

Examples of the recording paper P to which the toner image is transferred include plain paper used for an electrophotographic copying machine, a printer, and the like. Other than the recording paper P, an OHP sheet and the like can be used as the recording medium.

In order to further improve the smoothness of the image surface after fixing, the recording paper P has a smooth surface and, for example, coated paper formed by coating the surface of plain paper with a resin or the like, art paper for printing, or the like can be used.

The recording paper P after the completion of fixing of the color image is discharged to a discharge part, and a series of color image forming operations is finished.

<Process Cartridge/Toner Cartridge>

A process cartridge according to an exemplary embodiment of the present disclosure is described.

The process cartridge according to the exemplary embodiment is a process cartridge detachably mounted on the image forming apparatus and including a developing unit which contains the electrostatic image developer according to the exemplary embodiment and develops, as the toner image with the electrostatic image developer, the electrostatic image formed on the image holding member.

The process cartridge according to the exemplary embodiment is not limited to the configuration described above and may have a configuration including the developing device and, if required, for example, at least one selected from other units such as the image holding member, the charging unit, the electrostatic image forming unit, and the transfer unit, etc.

An example of the process cartridge according to the exemplary embodiment is described below, but the process cartridge is not limited to this example. In the description below, principal parts shown in the drawings are described, but description of other parts is omitted.

Figure 2:
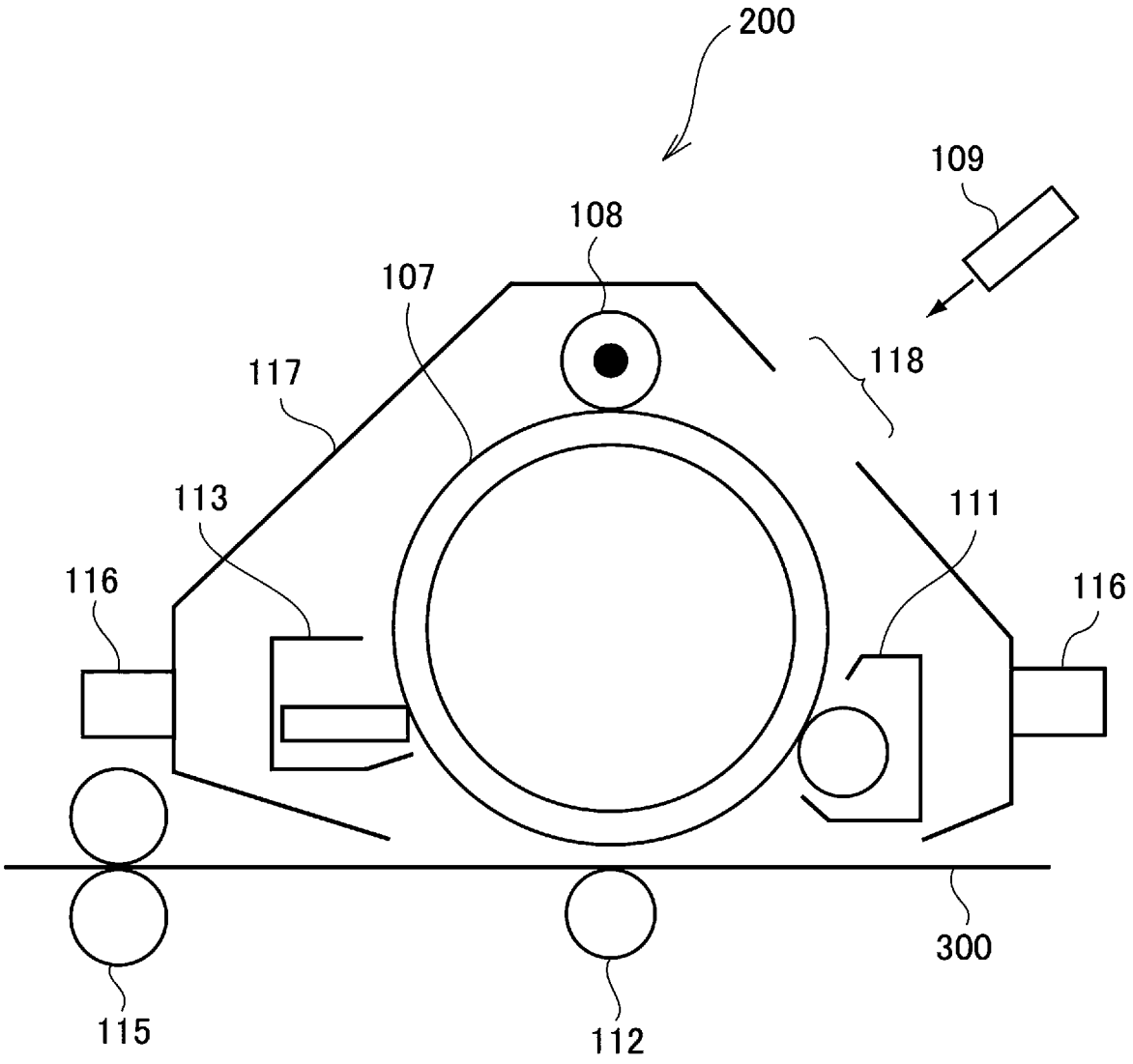
FIG. 2 a schematic configuration diagram showing a process cartridge according to an exemplary embodiment of the present disclosure.

FIG. 2 is a schematic configuration diagram showing the process cartridge according to the exemplary embodiment.

A process cartridge 200 shown in FIG. 2 is a cartridge with a configuration in which a photoreceptor 107 (an example of the image holding member) and a charging roller 108 (an example of the charging unit), a developing device 111 (an example of the developing unit), and a photoreceptor cleaning device 113 (an example of the cleaning unit), which are provided around the photoreceptor 107, are integrally held in combination by a housing 117 provided with a mounting rail 116 and an opening 118 for exposure.

In FIG. 2, reference numeral 109 denotes an exposure device (an example of the electrostatic image forming unit), reference numeral 112 denotes a transfer device (an example of the transfer unit), reference numeral 115 denotes a fixing device (an example of the fixing unit), and reference numeral 300 denotes recording paper (an example of the recording medium).

Next, a toner cartridge according to an exemplary embodiment of the present disclosure is described.

The toner cartridge according to the exemplary embodiment is a toner cartridge containing the toner according to the exemplary embodiment and being detachable from the image forming apparatus. The toner cartridge is intended to contain the toner for replenishment to supply the toner to the developing unit provided in the image forming apparatus.

The image forming apparatus shown in FIG. 1 is an image forming apparatus having a configuration in which toner cartridges 8Y, 8M, 8C, and 8K are detachably provided. Each of developing units 4Y, 4M, 4C, and 4K is connected to the toner cartridge of the corresponding developing device (color) through a toner supply tube (not shown). Also, when the amount of the toner contained in the toner cartridge is decreased, the toner cartridge is exchanged.

EXAMPLES

Exemplary embodiments of the present disclosure are described in further detail below by giving examples and comparative examples, but the exemplary embodiments are not limited to these examples. In addition, "parts" and "%" are on a mass basis unless particularly specified.

<Formation of Toner Particles>

(Toner Particles (1))

—Preparation of Polyester Resin Dispersion—

Ethylene glycol [manufactured by Wako Pure Chemical Industries, Ltd.] 37 parts

Neopentyl glycol [manufactured by Wako Pure Chemical Industries, Ltd.) 65 parts 1,9-Nonanediol [manufactured by Wako Pure Chemical Industries, Ltd.] 32 parts Terephthalic acid [manufactured by Wako Pure Chemical Industries, Ltd.] 96 parts The monomers described above are added to a flask and heated to a temperature of 200° C. over 1 hour, and after stirring in the reaction system is confirmed, 1.2 parts of dibutyltin oxide is added. Further, the temperature is increased to 240° C. over 6 hours while the produced water is distilled off, and dehydration condensation reaction is further continued at 240° C. for 4 hours, producing a polyester resin A having an acid value of 9.4 mgKOH/g, a weight-average molecular weight of 13,000, and a glass transition temperature of 62° C.

Next, the polyester resin A kept in a molten state is moved to Cavitron CD1010 (manufactured by Eurotech Co., Ltd.) at a speed of 100 parts per minute. Dilute ammonia water at a concentration of 0.37% prepared by diluting reagent ammonia water with ion exchange water is placed in an aqueous medium tank separately prepared and moved to Cavitron at the same time as the polyester resin melt at a speed of 0.1 liter per minute while being heated at 120° C. by a heat exchanger. Cavitron is operated under the conditions including a rotor rotational speed of 60 Hz and a pressure of 5 kg/cm$^2$, preparing an amorphous polyester resin dispersion in which resin particles having a volume-average particle diameter of 160 nm, a solid content of 30%, a glass transition temperature of 62° C., and a weight-average molecular weight Mw of 13,000 are dispersed.

—Preparation of Coloring Agent Particle Dispersion—

Cyan pigment [Pigment Blue 15:3, manufactured by Dainichiseika Color & Chemicals Mfg. Co., Ltd.] 10 parts Anionic surfactant [Neogen SC, manufactured by Daiichi Kogyo Seiyaku Co., Ltd.] 2 parts Ion exchange water 80 parts The components described above are mixed and dispersed for 1 hour by using a high-pressure collision-type disperser Ultimaizer [HJP 30006, manufactured by Sugino Machine Ltd.] to prepare a coloring agent particle dispersion having a volume-average particle diameter of 180 nm and a sold content of 20%.

—Preparation of Release Agent Particle Dispersion—

Paraffin wax [HNP 9, manufactured by Nippon Seiro Co., Ltd.) 50 parts

Anionic surfactant (Neogen SC, manufactured by Daiichi Kogyo Seiyaku Co., Ltd.] 2 parts Ion exchange water 200 parts These components are heated to 120° C., sufficiently mixed and dispersed by using Ultra-Turrax T50 manufactured by IKA Corporation, and then dispersed by using a pressure discharge-type homogenizer, thereby preparing a release agent particle dispersion having a volume-average particle diameter of 200 nm and a solid content of 20%.

—Formation of Toner Particles—

Polyester resin particle dispersion 200 parts

Coloring agent particle aqueous dispersion 25 parts

Release agent particle dispersion 30 parts

Polyaluminum chloride 0.4 parts

Ion exchange water 100 parts

The components described above are placed in a stainless-made flask, sufficiently mixed and dispersed by using Ultra-Turrax manufactured by IKA Corporation, and then heated to 48° C. under stirring in the flask in an oil bath for heating. After the resultant dispersion is maintained at 48° C. for 30 minutes, 70 parts of the polyester resin dispersion described above is slowly added.

Then, the system is adjusted to pH 8.0 by using an aqueous sodium hydroxide solution at a concentration of 0.5 mol/L, and then in the closed stainless-made flask, the resultant mixture is heated to 90° C. and maintained for 3 hours while stirring is continued with a magnetic force seal of a stirring shaft seal. After the reaction is terminated, the reaction product is cooled at a cooling rate of 2° C./min, filtered, and sufficiently washed with ion exchange water, followed by solid-liquid separation by Nutsche suction filtration. Further, the product is again dispersed by using 3 L of ion exchange water at 30° C. and then stirred and washed for 15 minutes at 300 rpm. The washing operation is further repeated six times, and when the filtrate has pH 7.54 and an electrical conductivity of 6.5 μS/cm, solid-liquid separation is performed by Nutsche suction filtration using No. 5A filter. Next, vacuum drying is continued for 12 hours to produce toner particles (1).

The volume-average particle diameter D50v of the toner particles (1) is 5.8 pin.

<Preparation of External Additive>

(Preparation of Abrasive Particles (Ab1))

Strontium chloride in a molar amount equivalent to titanium oxide is added to a metatitanic acid slurry, and then ammonia water is added at the same time as when carbon dioxide gas in a molar amount of 2 times that of titanium oxide is brown in a flow rate of 1 L/min. In this case, he pH value is 8. The resultant precipitate is washed with water, dried at 110° C. for 24 hours, sintered at 800° C., mechanically ground, and then classified to prepare abrasive particles (Ab1) composed of strontium titanate particles. The number-average particle diameter of the resultant abrasive particles (Ab1) is as follows.

Abrasive particles (Ab1): strontium titanate particles (number-average particle diameter 0.12 μm)

(Preparation of Titanium Dioxide Particles (A2 to A5 and B2 to B5))

—Titanium Dioxide Particles (A2)—

First, iron powder is separated by dissolving ilmenite in sulfuric acid, and $TiO(OH)_2$ is produced by a wet precipitation method of producing $TiO(OH)_2$ by hydrolysis of $TiOSO_4$. In the process of producing $TiO(OH)_2$, hydrolysis, dispersion adjustment for nucleation, and water washing are performed. Then, 100 parts of the resultant $TiO(OH)_2$ is dispersed in 1000 parts of water, and 20 parts of isobutyl trimethoxysilane is added dropwise to the resultant dispersion under stirring at room temperature (25° C.). Next, the resultant mixture is filtered, and the residue is repeatedly washed with water. Then, metatitanic acid surface-hydrophobilized with isobutyl trimethoxysilane is dried at 130° C. to prepare titanium dioxide particles (A2) having a volume-average particle diameter of 20 nm, a BET specific surface area of 132 $m^2/g$, and a specific gravity of 3.4.

—Titanium Dioxide Particles (A3)—

Titanium dioxide particles (A3) are prepared by the same method as for the titanium dioxide particles (A2) except that metatitanic acid surface-hydrophobilized with isobutyl trimethoxysilane is dried at 160° C.

—Titanium Dioxide Particles (A4)—

Titanium dioxide particles (A4) are prepared by the same method as for the titanium dioxide particles (A2) except that metatitanic acid surface-hydrophobilized with isobutyl trimethoxysilane is dried at 100° C.

—Titanium Dioxide Particles (A5)—

Titanium dioxide particles (A5) are prepared by the same method as for the titanium dioxide particles (A2) except that metatitanic acid surface-hydrophobilized with isobutyl trimethoxysilane is dried at 200° C.

—Titanium Dioxide Particles (B2)—

Titanium dioxide particles (B2) are prepared by the same method as for the titanium dioxide particles (A2) except that metatitanic acid surface-hydrophobilized with isobutyl trimethoxysilane is dried at 400° C.

—Titanium Dioxide Particles (B3)—

Titanium dioxide particles (B3) are prepared by the same method as for the titanium dioxide particles (A2) except that metatitanic acid surface-hydrophobilized with isobutyl trimethoxysilane is dried at 600° C.

—Titanium Dioxide Particles (B4)—

Titanium dioxide particles (B4) are prepared by the same method as for the titanium dioxide particles (A2) except that metatitanic acid surface-hydrophobilized with isobutyl trimethoxysilane is dried at 350° C.

—Titanium Dioxide Particles (B5)—

Titanium dioxide particles (B5) are prepared by the same method as for the titanium dioxide particles (A2) except that metatitanic acid surface-hydrophobilized with isobutyl trimethoxysilane is dried at 700° C.

<Preparation of Carrier>

First, 14 parts of styrene, 2 parts of a styrene-methacrylate copolymer (polymerization mass ratio of 90:10, weight-average molecular weight of 80,000), and 0.2 parts of carbon black (R330 manufactured by Cabot Corporation) are mixed and then stirred with a stirrer for 10 minutes to prepare a dispersion. Next, the resultant dispersion and 100 parts of ferrite particles (volume-average particle diameter of 36 μm) are placed in a vacuum deaeration kneader and stirred at 60° C. for 30 minutes, and then deaerated and dried under reduced pressure under heating to produce a carrier.

<Preparation of Externally Added Carrier (C1)>

First, 0.05 parts of the titanium dioxide particles (B1) as titanium dioxide particles (B) are added to 100 parts of the carrier, stirred at 40 rpm for 20 minutes in a V-shaped blender, and then passed through a sieve with an opening of 75 μm to produce an externally added carrier (C1).

<Preparation of Externally Added Carriers (C2) to (C5)>

Externally added carriers (C2) to (C5) are prepared by the same method as the externally added carrier (C1) except that the type and amount of the titanium dioxide particles (B) added are changed as described in Tale 1.

<Preparation of Toner (T1)>

To 100 parts of the toner particles (1), 1 part of the titanium dioxide particles (A1) as titanium dioxide particles (A), 0.04 parts of fatty acid metal salt particles (FM1), 0.04 parts of the abrasive particles (Ab1), and 2.0 parts of silica particles (A200 manufactured by Aerosil Co., Ltd.) are added and blended at a peripheral speed of 30 m/s for 15 minutes by using a Henschel mixer, an then coarse particles are removed by using a sieve having an opening of 45 μm, preparing a toner (T1).

<Preparation of Toners (T2) to (T11)>

Toners (T2) to (T11) are prepared by the same method as the toner (T1) except that the types and amounts of the titanium dioxide particles (A), fatty acid metal salt particles, and abrasive particles added are changed as described in Tale 2.

Example 1

The resultant toner (T1) and the externally added carrier (C1) are placed at a toner:externally added carrier ratio of 5:95 (mass ratio) in a V-blender and stirred for 20 minutes to produce a developer (1).

Examples 2 to 19 and Comparative Example 1

A developer is produced by the same method as in Example 1 except that the types of the toner and the externally added carrier are changed according to Table 3.

<Evaluation>

The image density unevenness of the developer produced in each of the examples is evaluated. The results are shown in Table 3.

(Evaluation of Image Density Unevenness)

The image density unevenness is evaluated as follows.

The resultant developer is filled in a developing device of an image forming apparatus "Docu Centre Color 450CP (Manufactured by Fuji Xerox Co., Ltd.) adjusted so as to enable development with a positive charge toner, allowed to stand in a high-temperature high-humidity (28° C., 85% RH) environment for one night, and then allowed to stand in a low-temperature low-humidity (10° C., 15% RH) environment for one night.

Then, in the low-temperature low-humidity (10° C., 15% RH) environment, an image with an image density of 2.5% is output on 10,000 sheets, and an image with an image density of 80% is output on the sheets. The image density is measured at 5 points of each of the images by using X-Rite 938 (manufactured by X-Rite, Inc.), and the average image density and standard deviation are calculated.

The evaluation criteria are as follows.

—Evaluation Criteria—

A: Standard deviation≤0.1

B: 0.1<standard deviation≤0.3

C: 0.3<standard deviation≤0.5

D: 0.5<standard deviation≤0.7

The details of the titanium dioxide particles (A) described in Table 2 are as follows.

Titanium dioxide particles (A1): STT100H, Tayca Corporation, refractive index: 2.2, crystallite diameter: 14 nm, number-average particle diameter: 0.02 μm Titanium dioxide particles (A2): titanium dioxide particles (trade name or the like) formed at a sintering temperature of 130° C., refractive index: 2.1, crystallite diameter: 13 nm, number-average particle diameter: 0.02 μm Titanium dioxide particles (A3): titanium dioxide particles formed at a sintering temperature of 160° C., refractive index: 2.3, crystallite diameter: 15 nm, number-average particle diameter: 0.02 μm Titanium dioxide particles (A4): titanium dioxide particles formed at a sintering temperature of 100° C., refractive index: 2.0, crystallite diameter: 12 nm, number-average particle diameter: 0.02 μm Titanium dioxide particles (A5): titanium dioxide particles formed at a sintering temperature of 200° C., refractive index: 2.4, crystallite diameter: 16 nm, number-average particle diameter: 0.02 μm The details of the titanium dioxide particles (B), fatty acid metal salt particles, and abrasive described in Table 1 are as follows.

Titanium dioxide particles (B1): JMT2000, Tayca Corporation, refractive index: 2.7, crystallite diameter: 42 nm, number-average particle diameter: 0.02 μm Titanium dioxide particles (B2): titanium dioxide particles formed at a sintering temperature of 400° C., refractive index: 2.6, crystallite diameter: 41 nm, number-average particle diameter: 0.02 μm Titanium dioxide particles (B3): titanium dioxide particles formed at a sintering temperature of 600° C., refractive index: 2.8, crystallite diameter: 43 nm, number-average particle diameter: 0.02 μm Titanium dioxide particles (B4): titanium dioxide particles formed at a sintering temperature of 350° C., refractive index: 2.5, crystallite diameter: 40 nm, number-average particle diameter: 0.02 μm Titanium dioxide particles (B5): titanium dioxide particles formed at a sintering temperature of 700° C., refractive index: 2.9, crystallite diameter: 44 nm, number-average particle diameter: 0.02 μm Fatty acid metal salt particles (FM1): produced by classifying Mz-2 of NOF Corporation using an elbow jet classifier (Nittetsu Mining Co. Ltd., EJ-L-3 (LABO)) to obtain a number-average particle diameter of 1 μm.

Fatty acid metal salt particles (FM2): produced by classifying Mz-2 of NOF Corporation using an elbow jet classifier (Nittetsu Mining Co. Ltd., EJ-L-3 (LABO)) to obtain a number-average particle diameter of 5 μm.

Fatty acid metal salt particles (FM3): produced by classifying Mz-2 of NOF Corporation using an elbow jet classifier (Nittetsu Mining Co. Ltd., EJ-L-3 (LABO)) to obtain a number-average particle diameter of 0.5 μm.

Fatty acid metal salt particles (FM4): produced by classifying Mz-2 of NOF Corporation using an elbow jet classifier (Nittetsu Mining Co. Ltd., EJ-L-3 (LABO)) to obtain a number-average particle diameter of 10 μm.

Abrasive particles (Ab1): strontium titanate particles (number-average particle diameter: 1.0 μm)

Abrasive particles (Ab2): strontium titanate particles (number-average particle diameter: 5.0 μm)

Abrasive particles (Ab3): strontium titanate particles (number-average particle diameter: 0.5 μm)

The "Polarity" is shown by the sign of surface potential of the fatty acid metal salt particles.

The "-" described in the toner type (T7) represents not containing the fatty acid metal salt particles and the abrasive particles.

"(A)/(B)×100" described in Table 3 represents the content by mass % of the titanium dioxide particles (A) relative to the content of the titanium dioxide particles (B) in the electrostatic image developer.

"(FM)/(A)×100" described in Table 3 represents the content by mass % of the fatty acid metal salt particles relative to the content of the titanium dioxide particles (A).

"(Ab)/(A)×100" described in Table 3 represents the content of the abrasive to the content of the titanium dioxide particles (A).

TABLE 1

| Externally added | Titanium dioxide particle (B) | | | |
|---|---|---|---|---|
| carrier type | Type | Parts | Refractive index | Crystallite diameter |
| (C1) | (B1) | 0.05 | 2.7 | 42 nm |
| (C2) | (B2) | 0.05 | 2.6 | 41 nm |
| (C3) | (B3) | 0.05 | 2.8 | 43 nm |
| (C4) | (B4) | 0.05 | 2.5 | 40 nm |
| (C5) | (B5) | 0.05 | 2.9 | 44 nm |

TABLE 2

| Toner | | | Titanium dioxide particle (A) | | | | Fatty acid metal salt particle | | | Abrasive | |
|---|---|---|---|---|---|---|---|---|---|---|---|
| Toner type | Toner particle Type | Toner particle Parts | Type | Parts | Refractive index | Crystallite diameter | Type | Parts | Polarity | Type | Parts |
| (T1) | (1) | 100 | (A1) | 1 | 2.2 | 14 nm | (FM1) | 0.04 | Positive | (Ab1) | 0.04 |
| (T2) | (1) | 100 | (A2) | 1 | 2.1 | 13 nm | (FM1) | 0.04 | Positive | (Ab1) | 0.04 |
| (T3) | (1) | 100 | (A3) | 1 | 2.3 | 15 nm | (FM1) | 0.04 | Positive | (Ab1) | 0.04 |
| (T4) | (1) | 100 | (A4) | 1 | 2.0 | 12 nm | (FM1) | 0.04 | Positive | (Ab1) | 0.04 |
| (T5) | (1) | 100 | (A5) | 1 | 2.4 | 16 nm | (FM1) | 0.04 | Positive | (Ab1) | 0.04 |
| (T6) | (1) | 100 | (A1) | 1 | 2.2 | 14 nm | (FM2) | 0.04 | Negative | (Ab1) | 0.04 |
| (T7) | (1) | 100 | (A1) | 1 | 2.2 | 14 nm | — | — | — | — | — |
| (T8) | (1) | 100 | (A1) | 1 | 2.2 | 14 nm | (FM3) | 0.04 | Positive | (Ab1) | 0.04 |
| (T9) | (1) | 100 | (A1) | 1 | 2.2 | 14 nm | (FM4) | 0.04 | Positive | (Ab1) | 0.04 |
| (T10) | (1) | 100 | (A1) | 1 | 2.2 | 14 nm | (FM1) | 0.04 | Positive | (Ab2) | 0.04 |
| (T11) | (1) | 100 | (A1) | 1 | 2.2 | 14 nm | (FM1) | 0.04 | Positive | (Ab3) | 0.04 |

TABLE 3

| | Externally carrier | | Titanium dioxide particle (A) | | Titanium dioxide particle (B) | | | | | Evaluation density |
|---|---|---|---|---|---|---|---|---|---|---|
| | type added | Toner type | Refractive index | Crystallite diameter | Refractive index | Crystallite diameter | (A)/(B) × 100 | (FM)/(A) × 100 | (Ab)/(A) × 100 | unevenness result of image |
| Example 1 | (C1) | (T1) | 2.2 | 14 nm | 2.7 | 42 nm | 0.5% | 4% | 4% | A |
| Example 2 | (C1) | (T2) | 2.1 | 13 nm | 2.7 | 42 nm | 0.4% | 4% | 4% | B |
| Example 3 | (C1) | (T3) | 2.3 | 15 nm | 2.7 | 42 nm | 0.6% | 7% | 3% | B |
| Example 4 | (C2) | (T1) | 2.2 | 14 nm | 2.6 | 41 nm | 0.5% | 3% | 7% | B |
| Example 5 | (C3) | (T1) | 2.2 | 14 nm | 2.8 | 43 nm | 0.4% | 2% | 9% | B |
| Example 6 | (C2) | (T1) | 2.2 | 14 nm | 2.6 | 41 nm | 0.5% | 9% | 2% | C |
| Example 7 | (C1) | (T2) | 2.1 | 13 nm | 2.7 | 42 nm | 0.6% | 4% | 5% | C |
| Example 8 | (C1) | (T4) | 2.0 | 12 nm | 2.7 | 42 nm | 0.5% | 5% | 4% | C |
| Example 9 | (C1) | (T5) | 2.4 | 16 nm | 2.7 | 42 nm | 0.8% | 3% | 4% | C |
| Example 10 | (C4) | (T1) | 2.2 | 14 nm | 2.5 | 40 nm | 0.1% | 4% | 3% | C |
| Example 11 | (C5) | (T1) | 2.2 | 14 nm | 2.9 | 44 nm | 0.5% | 6% | 4% | C |
| Example 12 | (C1) | (T1) | 2.2 | 14 nm | 2.7 | 42 nm | 0.01% | 4% | 6% | C |
| Example 13 | (C1) | (T1) | 2.2 | 14 nm | 2.7 | 42 nm | 1% | 6% | 6% | C |
| Example 14 | (C1) | (T8) | 2.2 | 14 nm | 2.7 | 42 nm | 0.5% | 0.1% | 5% | C |
| Example 15 | (C1) | (T9) | 2.2 | 14 nm | 2.7 | 42 nm | 0.4% | 20% | 6% | C |
| Example 16 | (C1) | (T10) | 2.2 | 14 nm | 2.7 | 42 nm | 0.6% | 2% | 0.1% | C |
| Example 17 | (C1) | (T11) | 2.2 | 14 nm | 2.7 | 42 nm | 0.5% | 4% | 20% | C |
| Example 18 | (C1) | (T6) | 2.2 | 14 nm | 2.7 | 42 nm | 0.6% | 3% | 4% | C |
| Example 19 | (C4) | (T4) | 2.0 | 12 nm | 2.5 | 40 nm | 0.4% | 4% | 3% | C |
| Comparative Example 1 | (C1) | (T7) | 2.2 | 14 nm | 2.7 | 42 nm | 0.5% | 0% | 0% | D |

The results described above indicate that in the examples, the image density unevenness caused by repeatedly forming a high-density image is suppressed as compared with in the comparative example.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An electrostatic image developer comprising:
a toner containing toner particles;
a carrier; and
an external additive containing titanium dioxide particles of two types having different refractive indexes, fatty acid metal salt particles, and an abrasive,
wherein the titanium dioxide particles of two types having different refractive indexes include titanium dioxide particles (A) adhered to the toner particles and titanium dioxide particles (B) adhered to the carrier;
a content of the titanium dioxide particles (A) is 0.1% by mass or more and 50% by mass or less relative to a content of the titanium dioxide particles (B),
a refractive index of the titanium dioxide particles (A) is 2.0 or more and less than 2.4;
a refractive index of the titanium dioxide particles (B) is 2.4 or more and 2.8 or less; and
the titanium dioxide particles (A) are obtained by treating titanium dioxide particles with one or more hydrophobilization treatment agents selected from the group consisting of a silane coupling agent, silicone oil, a titanate-based coupling agent, and an aluminum-based coupling agent.

2. The electrostatic image developer according to claim 1,
wherein the fatty acid metal salt particles are fatty acid zinc particles; and
the abrasive is composed of titanic acid metal salt particles.

3. The electrostatic image developer according to claim 2,
wherein the fatty acid metal salt particles are zinc stearate particles; and
the abrasive is composed of strontium titanate particles.

4. The electrostatic image developer according to claim 1,
wherein a content of the fatty acid metal salt particles is 1% by mass or more and 10% by mass or less relative to a content of the titanium dioxide particles (A).

5. The electrostatic image developer according to claim 1,
wherein a content of the fatty acid metal salt particles is 2% by mass or more and 9% by mass or less relative to a content of the titanium dioxide particles (A).

6. The electrostatic image developer according to claim 1,
wherein a content of the fatty acid metal salt particles is 3% by mass or more and 8% by mass or less relative to a content of the titanium dioxide particles (A).

7. The electrostatic image developer according to claim 2,
wherein a content of the fatty acid metal salt particles is 1% by mass or more and 10% by mass or less relative to a content of the titanium dioxide particles (A).

8. The electrostatic image developer according to claim 3,
wherein a content of the fatty acid metal salt particles is 1% by mass or more and 10% by mass or less relative to a content of the titanium dioxide particles (A).

9. The electrostatic image developer according to claim 1,
wherein a content of the abrasive is 1% by mass or more and 10% by mass or less relative to a content of the titanium dioxide particles (A).

10. An electrostatic image developer comprising:
a toner containing toner particles;
a carrier; and
an external additive containing titanium dioxide particles of two types having different crystallite diameters, fatty acid metal salt particles, and an abrasive,
wherein the titanium dioxide particles of two types having different crystallite diameters include titanium dioxide particles (A) adhered to the toner particles and titanium dioxide particles (B) adhered to the carrier;
wherein the titanium dioxide particles of two types having different refractive indexes include titanium dioxide particles (A) adhered to the toner particles and titanium dioxide particles (B) adhered to the carrier;
a refractive index of the titanium dioxide particles (A) is lower than a refractive index of the titanium dioxide particles (B);
a content of the titanium dioxide particles (A) is 0.1% by mass or more and 50% by mass or less relative to a content of the titanium dioxide particles (B);
a crystallite diameter of the titanium dioxide particles (A) is 12 nm to 16 nm;
a crystallite diameter of the titanium dioxide particles (B) is 40 to 44 nm; and
the titanium dioxide particles (A) are obtained by treating titanium dioxide particles with one or more hydrophobilization treatment agents selected from the group consisting of a silane coupling agent, silicone oil, a titanate-based coupling agent, and an aluminum-based coupling agent.

11. A process cartridge detachable from an image forming apparatus, comprising:
a developing unit that contains the electrostatic image developer according to claim 1 and that develops, as a toner image with the electrostatic image developer, an electrostatic image formed on a surface of an image holding member.

12. An image forming apparatus comprising:
an image holding member;
a charging unit that charges a surface of the image holding member;
an electrostatic image forming unit that forms an electrostatic image on the charged surface of the image holding member;
a developing unit that contains the electrostatic image developer according to claim 1 and that develops, as a toner image with the electrostatic image developer, the electrostatic image formed on the surface of an image holding member;
a transfer unit that transfers the toner image formed on the surface of the image holding member to a surface of a recording medium; and
a fixing unit that fixes the toner image transferred to the surface of the recording medium.

13. An image forming method comprising:
charging a surface of an image holding member;
forming an electrostatic image on the charged surface of the image holding member;

developing, as a toner image with the electrostatic image developer according to claim 1, the electrostatic image formed on the surface of an image holding member;

transferring the toner image formed on the surface of the image holding member to a surface of a recording medium; and fixing the toner image transferred to the surface of the recording medium.

* * * * *